United States Patent [19]

Gracia

[11] Patent Number: 4,663,911

[45] Date of Patent: May 12, 1987

[54] DEVICE FOR SECURING PROFILES FOR CONCEALED SUSPENSION LATTICE WORK CEILINGS

[75] Inventor: D. Enrique Sancho Gracia, Zaragoza, Spain

[73] Assignee: Andia Louvers, S.A., Spain

[21] Appl. No.: 738,071

[22] Filed: May 24, 1985

[30] Foreign Application Priority Data

May 24, 1984 [ES] Spain ..... 279463

[51] Int. Cl.[4] ..... E04B 5/52

[52] U.S. Cl. ..... 52/484; 52/664; 52/665

[58] Field of Search ..... 52/484, 664, 665, 729, 52/732

[56] References Cited

U.S. PATENT DOCUMENTS

| | | | |
|---|---|---|---|
| 2,071,865 | 2/1937 | Parsons | 52/484 X |
| 2,527,031 | 10/1950 | Rambusch | 52/484 X |
| 2,711,138 | 6/1955 | Hart | 52/665 X |
| 2,752,017 | 6/1956 | Segil | 52/484 |
| 2,939,543 | 6/1960 | Zingone | 52/484 X |
| 3,004,644 | 10/1961 | Hull | 52/484 |
| 3,035,672 | 5/1962 | Tuten et al. | 52/484 X |
| 3,911,638 | 10/1975 | Englund et al. | 52/665 X |

FOREIGN PATENT DOCUMENTS

| | | | |
|---|---|---|---|
| 666936 | 3/1965 | Belgium | 52/484 |

*Primary Examiner*—William F. Pate, III
*Assistant Examiner*—Creighton Smith
*Attorney, Agent, or Firm*—Darby & Darby

[57] ABSTRACT

A suspended ceiling, made up of a perfect framework of simple sheets, which from the esthetic and useful lattice-work covering the ceilings; these are long rectangular plastic or metal strips, with transversal semigrooves, spaced at modular dimensions and which enable the crossed assembly of the sheets themselves, thus forming the latticework; this latticework can be more or less dense, according to the distance between the semi-grooves. With this formation of the latticework, in the contour sheets of each covered surface there is a length-wise series of small holes, through which the suspension hook rods are inserted. These rods are simple cylindrical wires with curved ends, like hooks, and with a bend in their longitudinal half, to ensure better suspension assembly between the latticework and the upper frame or contour support section.

The contour sections are structural elements which support the aforementioned latticework sheet framework; these sections are made of laminated or extruded metal, forming a double "T" shape with lower extensions of the central core, the wing edges having some small angular folds like longitudinal edges and both the lower extended core and the wing edges are specially designed to enable quick and simple assembly of the complete structural securing device, as on the lower extended core there is a series of small windows which provide access to and secure the wires or hooks which hold the lower latticework and on the longitudinal edges of the wings the rapid-assembly framework is coupled by a seamings system by means of flat-action side latches by a spring between the cores and the wing edges of the contour sections, thus simple and economically forming the latticework which in turn is hung from the cladding or the ceilings through rod supports, adjustable in height by resilient angular pressure and quick manual action.

8 Claims, 3 Drawing Figures

FIG. 2
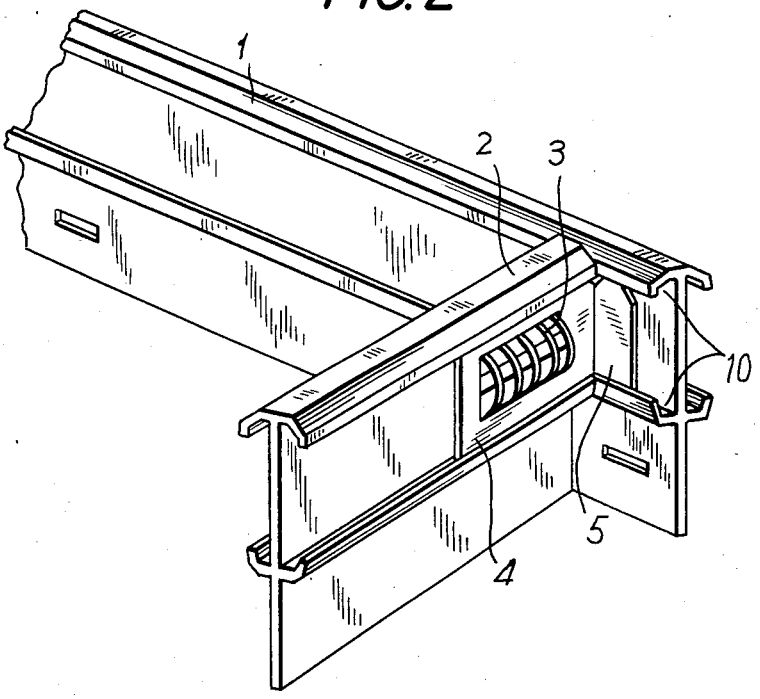
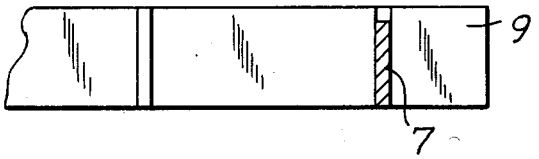
FIG. 3

DEVICE FOR SECURING PROFILES FOR CONCEALED SUSPENSION LATTICE WORK CEILINGS

The aim of this Utility Model is to declare the object of the privilege of exclusive industrial and commercial working in the national territory, in accordance with legislation in force on Industrial Property which, as the title indicates, concerns a device for securing profiles for concealed suspension latticework ceilings.

The model presented and disclosed is completely novel and of practical utility, since to arrange the formation and assembly or joins of the framework of latticework panels, the contour suspension profiles have absolutely no type of bolts and nuts or the like, thereby achieving speed, easy labour and economy in assembling; it should also be stressed that with this design submitted, the contour and suspension profiles are concealed, as the latticework really hangs form the latter, through specially shaped double hook rods, thus forming a diaphanous network cloth, without the profiled shapes or framework being seen, thereby giving a high quality, very attractive ornamental and decorative appearance as a whole.

The assembly device recognized also enables inner lighting to be installed entirely through the arrangement of fluorescent tubes either homogeneously or in isolated points.

The characteristic special novel cross-section of the contour or suspension profiles and the transversal framework profiles, is a double "T" with the central core extending at the bottom a length approximately the same as the inner height of the double "T"; the edges of the wings have rims, thus forming a kind of four inner channels, together with the central core, being two top ones (the top wing) and two bottom ones (the bottom wing).

This cross-section design has the main particularity of being able to be made on the top double "T" cross-section part and through the channels made by the rims of the aforementioned wings, with some clip parts like catch fingers mounted on the ends of the transversal profiles, thereby forming the joins, thus avoiding all types of bolts and nuts, rivets, etc., as indicated above. The joining device consists of the fact that each end of the transversal framework profiles and on the core between the wings of the profile, there is a small rectangular window, with two side protuberances in a horizontal direction; on these windows a part is coupled, like a rectangular sheet-like catch finger with a window like the one made on the core of the profile and on these windows a spring is mounted, secured and guided by the two protuberances mentioned. Said spring exerts sufficient strength on the catch finger which at the front has the button plate which is what is inserted in the channel of the cross-section of the opposing profile, thus making the aforementioned joins.

The rest of the assemblies making up the concealed suspension latticework ceiling device are as follows:

The suspension supports are mounted on the top wing of the aforementioned double "T" cross-section profile, arranged with a fork and adjustable longitudinal rod and on some rectangular holes distributed lengthwise through the bottom core of the contour and suspension profiles, some fine rods are inserted and mounted, like double hooks which, through holes, secure and hang the support sheets which carry and anchor the latticework panels through slotted transversal clips, thus forming the concealed suspension false ceiling.

To understand the foregoing better, and only by way of an unlimited example, two sheets of drawings are attached, in which:

FIG. 2 shows a detail of the join between the profiles.

FIG. 3 shows a detail of the latticework join with the support sheet.

Figure 1:
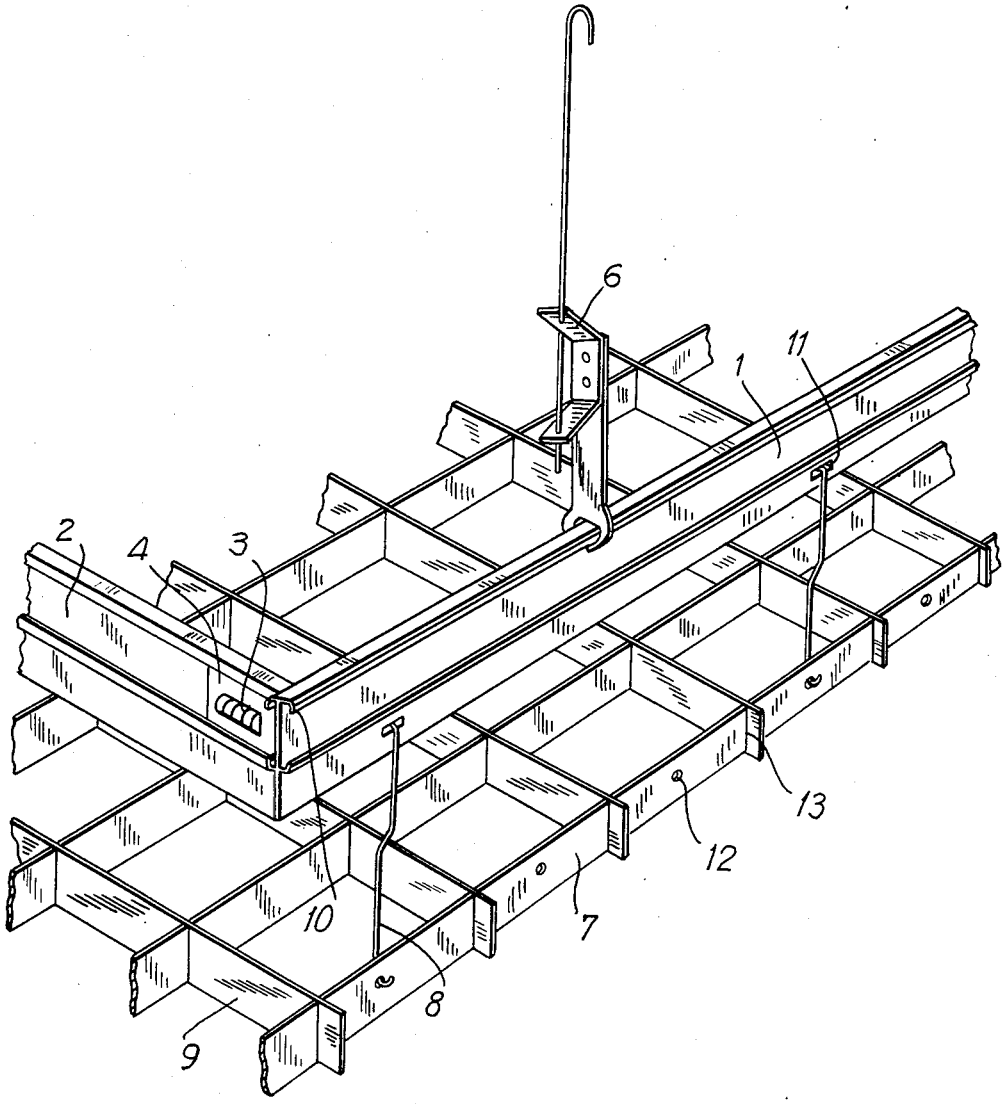
FIG. 1 shows a concealed assembly as a whole, with all the constituent elements.

In these figures, the following elements have been listed with the reference numbers given below:

1. Contour and suspension profile.
2. Transversal framework profile.
3. Spring
4. Catch finger
5. Catch finger button plate
6. Suspension support
7. Suspension support sheet
8. Suspension hook rod
9. Latticework network
10. Channels
11. Rectangular holes
12. Circular holes
13. Grooves Referring to the aforementioned illustrations which show a diagrammatic form of its industrial embodiment, only included merely with an informative nature, and consequently unlimiting, we have:

A device for securing profiles for concealed suspension latticework ceilings, comprising and formed by some contour and suspension profiles (1) with a special cross-section, joined to the transversal framework profiles (2) with the same cross-section, but arranged on their ends with the catch fingers (4) and joining and assembly springs (3) with the contour and suspension profiles (1) through channels (10). On the top wings of the contour and suspension profiles (1), the suspension supports (6) are mounted, with an adjustable height rod and on the lower core of the cross-section of these profiles, there is a series of rectangular holes (11) distributed lengthwise for anchoring and securing the suspension hook rods (8) which are connected at the bottom to the circular holes (12) of the suspension support sheets (7) of the lattice network (9), which through the grooves (13) made in the suspension support sheets (7) are inserted and interwoven transversally with the latticework sheets (9), thus mounting and forming the concealed suspension false ceiling.

After disclosing this invention, it is stated that what is declared as not practised or disclosed in Spain includes the following:

I claim:

1. A support structure for concealed suspension of latticework ceilings comprising:

first and second suspension profile members which are to be connected together at an angle, each said profile member having a cross-section which includes a double T-shaped configuration, one T being at the top of each said profile member and the other at a lower point thereon and defining a core area between said T's, and means for joining said two profile members together including a catch finger which extends along the core area of one profile member between the two T's thereof directly into the core area between the two T's of the other profile member, said joining means further comprising resilient means on one profile member for biasing said catch finger toward said other profile member, wherein said resilient means comprises a spring.

2. A structure as in claim 1 wherein each arm of the T member has a rim at the extremity thereof to form a channel with the core, the rims of the arms of each pair of T's disposed toward the other.

3. A structure as in claim 2 wherein said joining means further comprises resilient means on one prrofile member for biasing said catch finger toward said other profile member.

4. A support structure as in claim 3 wherein said resilient means comprises a spring.

5. A support structure as in claim 1 further comprising means fitting over the top T for hanging said structure to a surface above it.

6. A support structure as in claim 1 further comprising a plurality of rods having a hook at each end, the hook at one end fitting into a hole in said support structure and the hook at the other end fitting into a hole in said latticework ceiling.

7. A support structure as in claim 6 wherein the holes in said support structure are elongated in a direction generally transverse to the hooks which fit into them so that said hooks cannot become disengaged in the direction of hanging.

8. A support structure as in claim 6 wherein a rod has a bent section intermediate the hooks on the ends.

* * * * *